United States Patent [19]

Lotz

[11] 4,074,677

[45] Feb. 21, 1978

[54] OVEN DOOR FULL FRONT VIEWING PANEL

[75] Inventor: Lawrence C. Lotz, Marion, Ohio

[73] Assignee: Whirlpool Corporation, Benton Harbor, Mich.

[21] Appl. No.: 696,533

[22] Filed: June 16, 1976

[51] Int. Cl.[2] ..... F23M 7/04

[52] U.S. Cl. ..... 126/198; 126/200; 52/401; 52/502

[58] Field of Search ..... 126/198, 200; 52/397, 52/401, 502, 489

[56] References Cited

U.S. PATENT DOCUMENTS

| | | | |
|---|---|---|---|
| 2,617,160 | 11/1952 | Bodnar | 52/502 |
| 2,642,632 | 6/1953 | Savage | 52/502 |
| 2,901,786 | 9/1959 | Batts | 52/502 |
| 3,384,072 | 5/1968 | Davis et al. | 126/200 |
| 3,694,984 | 10/1972 | Schwartz | 52/502 |
| 3,877,460 | 4/1975 | Lotz et al. | 126/198 |
| 3,893,442 | 7/1975 | Nuss | 126/198 |
| 3,991,738 | 11/1976 | Krebs | 126/200 |

*Primary Examiner*—John J. Camby

*Assistant Examiner*—Larry I. Schwartz

*Attorney, Agent, or Firm*—Wegner, Stellman, McCord, Wiles & Wood

[57] ABSTRACT

A door construction having a full front viewing panel. An improved structure is provided for mounting the viewing panel in a front frame portion of the door. The mounting structure includes a plurality of resilient bumpers engaging an edge portion of the transparent panel. Retaining clips are provided for retaining the bumpers in securing association with the transparent panel. The frame is provided with recesses for receiving a positioning portion of the retaining elements to effect a desired clamping of the transparent panel by the resilient bumpers. The frame may be secured to the liner of the door by threaded securing elements and the retaining elements may be secured in the door further by the threaded securing elements. The door may comprise a hollow door having top and bottom openings for conducting ambient air therethrough to maintain a desired low temperature of the front transparent panel. The openings may be disposed adjacent the panel mounting elements.

17 Claims, 4 Drawing Figures

OVEN DOOR FULL FRONT VIEWING PANEL

BACKGROUND OF THE INVENTION

1. Field of the Invention

This invention relates to door structures and in particular to means for mounting a panel in a door structure.

2. Description of the Prior Art

In United States Letters Patent 3,877,460, of Larry C. Lotz et al, which patent is owned by the assignee hereof, a hollow heat insulating door is disclosed having a front viewing panel retained in a front frame by a plurality of rubber bumper members held in position by clamps located at the corner of the panel. Each clamp is held in position by screws secured to the frame. The disposition of the clamps is controlled by the rearward extension of mounting bosses to which the spurs are affixed in retaining the clamps against the rubber bumpers. The frame is provided with a flange outwardly of the clamp retaining screws. The front frame is secured to the rear liner by screws disposed rearwardly of the clamps.

Other United States Letters Patent showing means for mounting a glass panel in a frame member by spring clips and the like include U.S. Pat. Nos. 2,642,632, of Stanley Savage; 2,837,784 of Lawrence J. Jannette, and 3,389,505 of Abe Zitomer. In the Savage patent, a flat flexible strip of rubber or suitable joint sealing material is disposed between a shoulder on a window sash and the peripheral portion of the glass. The sealing strip extends entirely about the opening. In the Jannette patent, a sash construction is shown wherein a channel-shaped resilient flexible member formed of rubber or the like embraces the margins of the glass pane. In the Zitomer patent, the sealing gasket is mounted in grooves on the inner surfaces of the trim panels and extends completely around the opening in which the glass pane is fitted.

In United States Letters Patent 2,794,434, of Jesse L. Evans, an oven door is disclosed having a gasket of rubberlike material preferably circular in cross section mounted within a curled edge of an inwardly turned flange. The gasket engages the window pane which is held in place by U-shaped metal molding provided with tongues at spaced points.

In United States Letters Patent 2,877,761, of Raymond D. Schibley, an oven door window is shown wherein the frame is provided with continuous grooves in which are recieved continuous gaskets of suitable resilient material, such as asbestos. The glass viewing panels are biased toward each other and the gaskets maintained in compression by trim or clamping strips which bear against the outer surfaces of the glass panel. Each trim strip has tabs extending through suitable openings in the rim of the frame.

SUMMARY OF THE INVENTION

The present invention comprehends a door construction comprising a further improvement over that of the above described Lotz el al door structure. In the present door structure, the front panel is mounted to a frame member by a plurality of resilient bumpers retained in association with the peripheral edge of the panel by an improved retaining means. The bumpers may comprise L-shaped elements having an outer leg portion abutting an inwardly facing shoulder on the frame. A rear clamping portion of the bumpers is engaged with the rear surface of the peripheral edge portion of the panel and is compressed thereagainst by means of a retaining clip.

The retaining clip includes a positioning portion which is received in a positioning recess formed in the frame. The retaining clip is positioned thereby accurately to compress the clamping portion of the rubber bumper suitably against the glass peripheral edge portion to urge the glass against an inturned flange portion of the frame.

In the illustrated embodiment, the retaining clips further include securing portions extending rearwardly from the pressure-applying portion thereof so as to be clamped between a rearwardly extending rear portion of the frame and a forwardly extending front portion of the liner which, in the assembled arrangement of the door structure, are disposed in telescopic overlying relationship.

The retaining clips may further include slots in the securing portion thereof adapted to pass the threaded securing elements provided for securing the frame rear portion to the liner front portion. Thus, the retaining clips are effectively positively retained in the door structure with the positioning portion thereof maintained in the positioning recess of the frame to maintain the desired clamping of the viewing panel edge portion to the frame.

The panel mounting means of the present invention are extremely simple and economical of construction while yet providing the highly desirable features discussed above.

BRIEF DESCRIPTION OF THE DRAWING

Other features and advantages of the invention will be apparent from the following description taken in connection with the accompanying drawing wherein.

DESCRIPTION OF THE PREFERRED EMBODIMENT

Figure 1:
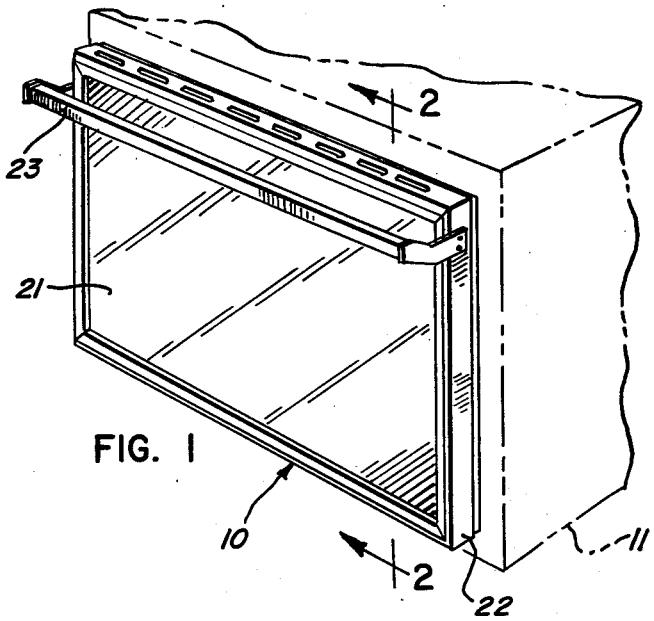
FIG. 1 is a fragmentary perspective view of a door construction provided with improved panel mounting means embodying the invention.

In the exemplary embodiment of the invention as disclosed in the drawing, a door construction 10 illustratively comprises a door for use in closing the front opening of a cabinet, such as an oven cabinet 11. The illustration of the door in connection with such an oven is illustrative only, it being understood that the door construction is adapted for advantageous utilization in other appliances and the like.

Figure 2:
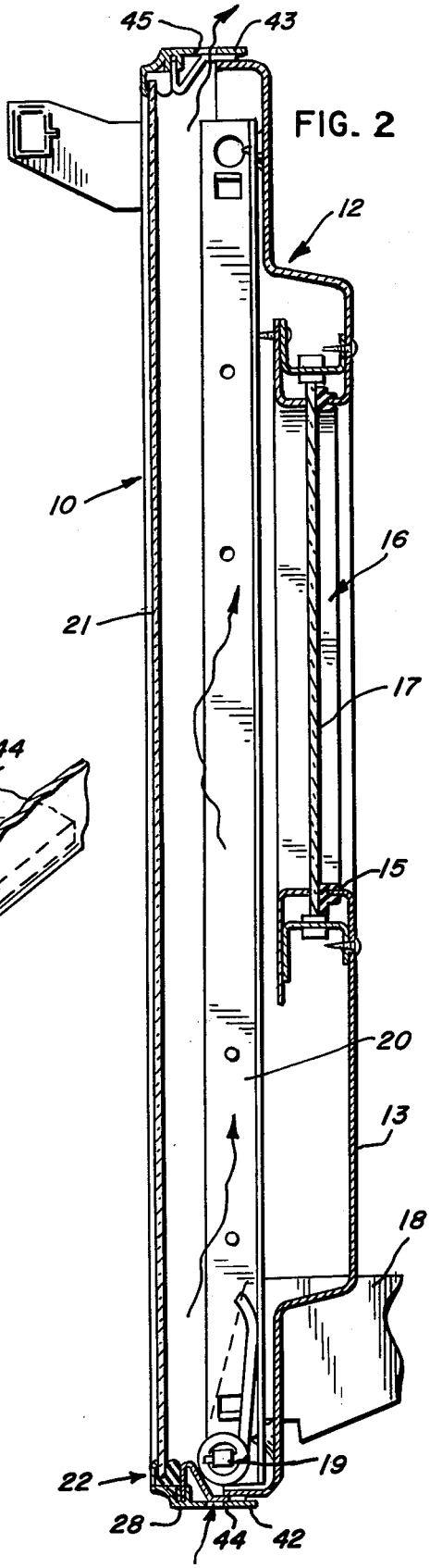
FIG. 2 is a fragmentary enlarged vertical section thereof taken substantially along the line 2—2 of FIG. 1.

As shown in FIG. 2, the door construction includes a rear liner assembly generally designated 12 including a liner panel 13 having a forwardly turned peripheral flange 14. Liner panel 13 further defines a window opening 15 in which may be intalled a rear viewing panel assembly generally designated 16 having a rear transparent panel 17.

The door construction may be provided with suitable mounting arms 18 which may be connected to a spring-loaded pivot 19 carried by suitable mounting brackets 20.

A front transparent viewing panel 21 is mounted in a frame 22 to extend generally coextensively to the liner and effectively define the front panel of the door structure. A suitable manipulating handle 23 may be secured to the frame, as shown in FIG. 1, for selective movement of the door on the mounting arms 18 as desired.

The frame includes a front inturned flange 24 defining a window opening 25 across which the transparent panel 21 extends. The transparent panel includes an edge portion 26 received behind flange 24.

Figure 3:
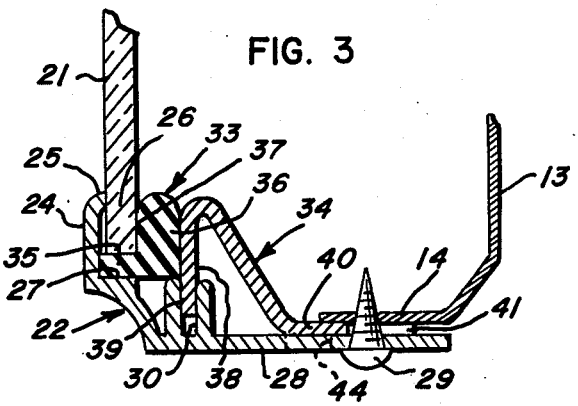
FIG. 3 is a fragmentary further enlarged vertical section illustrating in greater detail the construction of the panel mounting means.

The frame further defines an inwardly facing shoulder 27 rearwardly of flange 24 and outwardly of the pane portion 26, as best seen in FIG. 3.

As further shown in FIG. 3, the frame includes a rear securing portion 28 effectively defining a peripheral rearwardly extending flange which overlies the forwardly extending flange 14 of the liner panel 13 in telescopic relationship therewith in the assembled arrangement of the door structure. The frame securing portion 28 may be secured to the liner flange 14 by suitable securing means, such as threaded elements, or screws 29.

Figure 4:
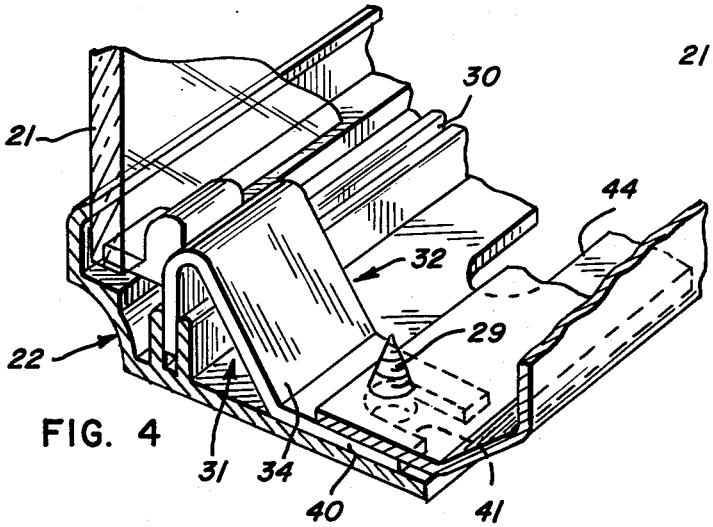
FIG. 4 is a fragmentary perspective view thereof.

The frame further defines an inwardly opening recess 30 rearwardly of the shoulder 27. As best seen in FIG. 4, the recess may comprise a continuous channel.

At spaced positions, such as position 31 illustrated in FIG. 4, improved retaining means generally designated 32 are provided for retaining the peripheral portion 26 of the viewing panel in the frame. More specifically, as shown in FIGS. 3 and 4, each retaining means includes a resilient bumper generally designated 33 and a retaining clip generally designated 34.

The bumper 33 comprises an L-section element formed of a suitable resilient material, such as silicone rubber or the like, and defines a forward leg 35 and a rear clamping portion 36. Leg 35 is received between viewing panel edge portion 26 and shoulder 27. Clamping portion 36 engages the outer surface 37 of the viewing panel portion 26. Herein panels 17 and 21 are formed of tempered glass.

Bumper clamping portion 36 is compressed against the panel surface 37 by a pressure-applying portion 38 of the retaining clip 34. The pressure-applying portion comprises an outturned flange at the forward end of the retaining clip bearing against the rear surface of the bumper clamping portion 36. The pressure-applying portion is accurately positioned relative to the frame flange 24 by means of a positioning portion 39 defining the distal end of the flange 38 being received in the recess 30 of the frame. More specifically, the recess 30 is spaced rearwardly of the frame flange 24 accurately to effect the desired compression of the bumper portion 36 to provide the desired clamping of the panel edge portion 26 of the frame flange 24.

As best seen in FIG. 4, the retaining clip further includes a rear securing portion 40 which may be provided with a rearwardly opening slot 41. The securing portion is adapted to be received between the frame rear portion 28 and the liner forward portion 14 to effectively preclude removal of the positioning portion 39 of the clip from the recess 30 in the assembled arrangement of the door.

To provide further improved retention of the retaining clips in the door structure, a number of these clips may be positioned, as shown in FIG. 4, with the frame securing screws 29 extending through the slots 41 of the clips.

As illustrated in FIG. 2, the bottom portion 42 and top portion 43 of the frame rear portion 28 may be provided with air flow openings 44 and 45, respectively. Thus, ambient air may flow through the hollow door to effect a continuous cooling of the door during use and thereby maintain the front transparent panel 21 at a desirable low temperature. As shown in FIG. 4, the air flow opening may be disposed adjacent the retaining means 32.

By use of the continuous channel 30, the retaining means 32 may be suitably disposed as desired at spaced portions about the frame 22. Thus, the positioning of the retaining means is not limited to corner portions of the door and any suitable number of retaining means may be employed for effectively mounting the front viewing panel to the frame.

The retaining means is extremely simple and economical of construction and may be readily installed or removed as for servicing of the door as desired.

The foregoing disclosure of specific embodiments is illustrative of the broad inventive concepts comprehended by the invention.

I claim:

1. In an oven door provided with a liner having a window, and a front transparent panel having an edge portion, the improvement comprising: a frame having a rear portion adjacent the liner, a forward portion including a front flange defining a front window opening, and a retainer portion defining an inwardly opening recess rearwardly of said flange; retaining means for retaining the front panel in said frame including a plurality of resilient bumpers at spaced portions of the frame each having a clamping portion engaging the rear surface of said front panel edge portion, a plurality of retaining clips associated one each with said plurality of bumpers, each clip including a front portion engaging said bumper clamping portion, a positioning portion received in said frame recess to position said clip front portion suitably to effect a preselected compression of said bumper clamping portion to clamp the front panel edge portion between said bumper clamping portion and said frame flange, and a securing portion; means for retaining said securing portion to prevent movement of said positioning portion inwardly from said frame recess and thereby effectively maintain the clamped mounting of the front panel to the frame; and securing means for removably securing said frame to said liner.

2. In an oven door provided with a liner having a window, and a front transparent panel having an edge portion, the improvement comprising: a frame having a rear portion adjacent the liner, a forward portion including a front flange defining a front window opening, and a retainer portion defining an inwardly opening recess rearwardly of said flange; retaining means for retaining the front panel in said frame including a plurality of resilient bumpers at spaced portions of the frame each having a clamping portion engaging the rear surface of said front panel edge portion, a plurality of retaining clips associated one each with said plurality of bumpers, each clip including a front portion engaging said bumper clamping portion, and a positioning portion received in said frame recess to position said clip front portion suitably to press against said bumper clamping portion to clamp the front panel edge portion between said bumper clamping portion and said frame mounting portion flange; and securing means for removably securing said frame to said liner, said securing means further securing said retaining clip in the door.

3. In an oven door provided with a liner having a window, and a front transparent panel having an edge portion, the improvement comprising: a frame having a rear portion adjacent the liner, a forward portion including a front flange defining a front window opening, and a retainer portion defining an inwardly opening recess rearwardly of said flange, retaining means for retaining the front panel in said frame including a plurality of resilient bumpers at spaced portions of the frame each having a clamping portion engaging the rear surface of said front panel edge portion, a plurality of retaining clips associated one each with said plurality of bumpers, each clip including a front portion engaging said bumper clamping portion, and a positioning portion received in said frame recess to position said clip front portion suitably to press against said bumper clamping portion to clamp the front panel edge portion between said bumper clamping portion and said frame mounting portion flange; and securing means for removably securing said frame to said liner, each of said retaining clips including a rear securing portion, and said securing means further securing said retaining clip securing portions in the door.

4. The door structure of claim 1 wherein said frame retainer portion recess comprises a channel extending lengthwise transversely to said front opening.

5. The door structure of claim 1 wherein said frame comprises an extruded metal frame.

6. The door structure of claim 1 wherein said bumpers have an L-shaped cross section.

7. The door structure of claim 1 wherein said bumpers have an L-shaped cross section defining a clamping portion rearwardly of the panel edge portion and an outer leg portion outwardly of the panel edge portion, said clamping portion having a thickness greater than that of said outer leg portion.

8. The door structure of claim 1 wherein said retaining clips include a rear securing portion, and said securing means further defines a portion of said retaining means, said securing means comprising threaded fastening elements extending through said frame rear portion and the securing portion of the retaining clips.

9. The door structure of claim 3 wherein each retaining clip securing portion is provided with a slot and said securing means comprises threaded fastening elements extending through said frame rear portion and the slots of the retaining clips.

10. In a door provided with a liner having a peripheral portion, and a front panel substantially coextensive with said liner and having an edge portion disposed forwardly of the liner peripheral portion, the improvement comprising:

a frame substantially coextensive with said front panel edge portion and having a rear portion adjacent said liner edge portion, a forward panel mounting portion including a front inturned flange defining a front opening, and an inwardly facing shoulder rearwardly of the inturned flange, and an intermediate retainer portion defining an inwardly opening recess;

retaining means for retaining the front panel in said frame including a plurality of resilient bumpers at spaced portions of the frame each having an outer forwardly extending leg extending between the front panel edge portion and said frame mounting portion shoulder, a rear clamping portion engaging the rear surface of said front panel edge portion, and a plurality of retaining clips associated one each with said plurality of bumpers, each clip including a front portion engaging said bumper clamping portion, a positioning portion received in said frame recess to position said clip front portion suitably to press against said bumper clamping portion to clamp the front panel edge portion between said bumper clamping portion and said frame mounting portion flange, and a securing portion removably secured in the door; and securing means for removably securing said frame and said clip securing portion to said liner.

11. In a door provided with a liner having a peripheral portion, and a front panel substantially coextensive with said liner and having an edge portion disposed forwardly of the liner peripheral portion, the improvement comprising: a frame substantially coextensive with said front panel edge portion and having a rear portion adjacent said liner edge portion, a forward panel mounting portion including a front inturned flange defining a front opening, and an inwardly facing shoulder rearwardly of the inturned flange, and an intermediate retainer portion defining an inwardly opening recess; retaining means for retaining the front panel in said frame including a plurality of resilient bumpers at spaced portions of the frame each having an outer forwardly extending leg extending between the front panel edge portion and said frame mounting portion shoulder, a rear clamping portion engaging the rear surface of said front panel edge portion, and a plurality of retaining clips associated one each with said plurality of bumpers, each clip including a front portion engaging said bumper clamping portion, a positioning portion received in said frame recess to position said clip front portion suitably to press against said bumper clamping portion to clamp the front panel edge portion between said bumper clamping portion and said frame mounting portion flange, and a securing portion removably secured in the door; and securing means for removably securing said frame to said liner, said retaining clip securing portion being received between said liner peripheral portion and said frame rear portion.

12. The door structure of claim 10 wherein said front panel is transparent.

13. The door structure of claim 10 wherein said liner is provided with a viewing panel opening and a rear transparent panel is mounted to the liner to extend across the liner viewing panel opening, said front panel comprising a transparent panel whereby the door defines a see-through door.

14. The door structure of claim 10 wherein said door comprises an oven door and said liner is provided with a viewing panel opening and a rear transparent panel is mounted to the liner to extend across the liner viewing panel opening, said front panel comprising a transparent panel whereby the door defines a see-through door, said transparent panels being formed of tempered glass.

15. The door structure of claim 10 wherein the securing portion of the retaining clips is provided with an opening and said securing means comprises threaded fastener elements extending through the securing portion opening.

16. The door structure of claim 10 wherein said frame includes an air flow opening adjacent said panel retaining means.

17. The door structure of claim 10 wherein said recess comprises a continuous channel.

* * * * *